US005179990A

United States Patent [19]

Marocco

[11] Patent Number: 5,179,990

[45] Date of Patent: Jan. 19, 1993

[54] TORQUE LIMITING DRIVE FOR BLINDS

[76] Inventor: Norbert Marocco, 46 Pennygrass Ct., Woodbridge, Ontario, Canada

[21] Appl. No.: 746,346

[22] Filed: Aug. 16, 1991

[51] Int. Cl.[5] ..... E06B 9/36

[52] U.S. Cl. ..... 160/176.1; 160/900

[58] Field of Search ..... 160/177, 176.1, 178.1, 160/168.1, 900, 172, 166.1

[56] References Cited

U.S. PATENT DOCUMENTS

| | | | |
|---|---|---|---|
| Re. 33,216 | 5/1990 | Marocco . | |
| 3,828,838 | 8/1974 | Anderle et al. | 160/176.1 |
| 3,860,056 | 1/1975 | Bruneau | 160/176.1 |
| 3,996,988 | 12/1976 | de Wit | 160/176.1 X |
| 4,103,727 | 8/1978 | Spohr | 160/176.1 X |
| 4,267,875 | 5/1981 | Koks | 160/176.1 |
| 4,350,197 | 9/1982 | Haller | 160/176.1 X |
| 4,541,468 | 9/1985 | Anderson | 160/177 |
| 4,616,688 | 10/1986 | Agos | 160/176.1 |
| 4,653,564 | 3/1987 | Marocco . | |
| 4,676,292 | 6/1987 | Valle et al. | 160/177 X |
| 4,848,435 | 7/1989 | Helver | 160/176.1 |
| 4,875,516 | 10/2489 | Marocco . | |
| 4,928,744 | 5/1990 | Oskam | 160/177 X |
| 4,945,970 | 8/0790 | Marocco . | |
| 5,010,940 | 4/3091 | Marocco . | |

*Primary Examiner*—David M. Purol

[57] ABSTRACT

A torque-limiting angle drive for blinds and having a housing, first and second bearings on the housing defining respective first and second rotational axes, a drive member rotatably supported in a bearing and having drive formations, a driven member rotatably supported in another other bearing, stops to define ends of a predetermined arc of rotation of the driven member, a plurality of driven formations on the driven member at spaced intervals therearound and, slipping formations arranged on one of the drive member and the driven member located so that when the driven member reaches one or other end of its arc of rotation, one or other of the slipping formations is disengaged whereby to provide a slipping action when the drive member is over-rotated.

40 Claims, 4 Drawing Sheets

TORQUE LIMITING DRIVE FOR BLINDS

FIELD OF THE INVENTION

The invention relates to blinds of the type having a worm and gear angle drive.

BACKGROUND OF THE INVENTION

Various forms of blinds, having slats, incorporate a worm and gear angle drive for rotating or tilting the slats. One form of such blind is the well known vertical blind. In such blinds a header rail supports a plurality of sliding carriers, and vertical blind slats hang downwardly from such carriers. The carriers are slidable along a drive rod, which can be rotated from one or other end of the track. Each of the carriers incorporates a worm and gear drive. When the drive rod is rotated the worm portion of the drive transmits movement to the gear portion of the drive which thus rotates the blind slats between open and closed positions.

In addition to providing a mechanism for rotating or tilting the slats, such blinds also provide a mechanism for the drawing or of the sliding carriers to one end or the other of the track, to open the window. Such mechanisms may incorporate a system of pull cords, or in some cases, may incorporate an elongated helical drive rod, with all of the carriers incorporating a internally helically threaded nut device, so that rotation of the helical drive rod will draw all of the carriers to one end of the rail or the other.

The components in such carriers and drives are almost invariably manufactured of thermoplastic material, and are relatively light, and, while having sufficient strength for the purpose for which they are intended, can be easily damaged if they are abused.

The operation of the drive rod is achieved either by means of a wand, or by means of a metal or plastic chain or a cord and a gear arrangement, being located at one or other end of the rail. The operation of the drive rod in a normal fashion for which it is intended will cause rotation of the blind slats between open and closed positions. However, if for some reason the drive rod is over-rotated, for example by a child, or by someone who is ignorant of the way in which such blind controls must be operated, then the plastic components in the worm and gear drives can become damaged, and the blind slats will no longer rotate.

In order to overcome this problem, manufacturers of such blinds have developed a torque limiting device or clutch, in the worm portion of the drive. The effect of this is that when the blind slat is fully rotated to a closed position, the gear portion of the drive reaches a stop, so that the blind slat cannot be rotated further. If the rod is then subject to over-rotation, the clutch in the worm portion of the drive will simply slip, and thus prevent the drive from becoming damaged.

Such devices are effective to prevent damage, and are popular. However, the components for such a torque limiting device must be fitted into a small space in each carrier. Typically, the worm portion of the drive will be no more than about 0.5 inches in diameter, and 0.25 inches in thickness. Such torque limiting devices incorporated in the worm unit are usually fabricated in two or three components, and they must fit together and occupy no more space than the worm unit without the torque limiting device. Consequently, the components of the torque limiting device are small, and must be manufactured with a relatively high degree of accuracy in order to function. As a result, existing torque limiting devices in such carriers are relatively expensive.

A further factor mitigating against the use of such torque limiting devices was the fact that as the parts became smaller, and at the same more complex, it required more and more highly skilled and highly trained personnel for the assembly of such blinds. This still further increased the expense of such blinds.

Clearly, it would be advantageous if a torque limiting device for use in such worm and gear drives could be devised which did not require several separate components since it would both reduce the cost of manufacture, and also reduce the complexity of the task of assembling the components together.

The assembly of these relatively intricate blind components and carriers is itself at best a tiresome manual task that must be carried out with great accuracy in order for the blind to function satisfactorily. One of the factors is that it is necessary to ensure that the gear portion of the drive, in the carrier, from which the individual slat is suspended, shall be oriented in the correct rotational position in each of the carriers. This is essential so that it ensures that each of the blind slats will always be suspended in a plane parallel to all of the other blind slats, so that when they are rotated to open and close, they present a uniform appearance.

It would therefore be highly advantageous if, in the design of such a torque limiting drive system, it was possible to ensure that it was "self aligning" in the sense that it could only be assembled, when the gear shafts were all in the correct rotational position.

While this discussion has dealt primarily with so-called vertical blinds, in which slats are hung from individual slidable carriers, it will be appreciated that it is also equally applicable to similar blinds when used overhead, i.e., with the slats at an angle, or horizontal, and also with minor modifications, to horizontal Venetian blinds, which also incorporate a worm and gear drive for tilting the slats.

In the past, proposals have been made to incorporate a torque limiting device in the worm and gear drive of a horizontal venetian blind. In this proposal, some of the teeth of the gear drive were simply altogether removed, so that the shaft around the arc where the teeth were removed presented a smooth generally semi-cylindrical surface. This system however was unsatisfactory. Once the gear drive had been rotated to the point where the teeth ended, there was then simply nothing at all for the worm to engage. In a sense this did in fact limit the torque, since there was no longer any torque of any kind transmitted from the work to gear drive. However, it was found that using this system, since the worm and gears were essentially disengaged at this point, it was not possible to then re-engage them and operate the worm and gear drive in the reverse direction. Consequently this system was unsatisfactory.

BRIEF SUMMARY OF THE INVENTION

With a view to overcoming various problems noted above, the invention comprises a torque limiting device for use with blinds, and comprising housing means adapted to be incorporated in a blind structure, a drive member rotatably supported on a first bearing means for rotation about its respective axis, and defining drive formation means, a driven member rotatably supported on a second bearing means for rotation about its respective axis, stop means adapted to define ends of a predetermined arc of rotation of said driven member, a plurality of driven formations on said driven member at spaced intervals therearound arranged in a group and extending substantially around said predetermined arc of rotation and, slipping formation means located at spaced intervals on one of said drive member and said driven member, and located whereby when said driven member reaches one or other end of its arc of rotation, one of said slipping formation means is disengaged between said drive member and said driven member, whereby when said drive member is further rotated, to urge said driven member to move beyond said stop means, a slipping action is provided therebetween.

The invention further provides such a torque-limiting device wherein said driven member comprises shaft means adapted to be located in one of said bearing means, and gear means on said shaft means, and wherein said driven formations comprise a group of teeth formed on said gear means, defining a predetermined height and profile.

The invention further provides such a torque-limiting device, and wherein said slipping formation means comprise gear means defining a profile different from that of said predetermined group of said teeth.

The invention further provides such a torque-limiting device wherein said slipping formation means define a profile having a height which is reduced as compared with the predetermined height of said group of said gear teeth.

The invention further provides such a torque-limiting device wherein said slipping formation means are teeth formed with a predetermined degree of resilient flexibility, which is greater than that of said group of said gear teeth.

The invention further provides a vertical blind assembly incorporating a plurality of blind carriers adapted to be slid to and fro along a rail, and wherein each of said carriers incorporates a torque-limiting device of the type described.

The invention further provides a venetian blind assembly of the type having a headrail, and a tilt rod extending therealong and a plurality of generally horizontal spaced apart blind slats suspended from said tilt rail, and worm and gear drive means at one end of said headrail F or operating said tilt rod, said worm and drive gear means incorporating a torque-limiting device of the type described.

In a further embodiment of the invention, such a torque-limiting device for use with blinds may be provided in a worm and gear assembly and wherein said gear assembly defines plurality of gear teeth therearound of regular symmetrical shape, and wherein said drive member defines worm drive formations formed therearound, some of said worm drive formations being of asymmetrical shape with relation to other of said worm drive formations, for forming said slipping formation means.

In a further embodiment of the invention, suitable for use with vertical blinds supported from blind carriers adapted to be slid to and fro along the head rail and wherein each of the carriers incorporate a worm and gear assembly, wherein the worm drive constitutes the drive gear means and wherein the gear constitutes the driven member and including bearing means for supporting said driven member, said bearing means being so formed as to permit said driven member to tilt away from a vertical axis, when said driven member reaches the limits of its rotation, for providing said slipping formation means.

In a still further embodiment of the invention, the bearing means for supporting the driven member is of asymmetrical shape and defines a flared portion whereby said driven member may be tilted out of its normal axis whereby to provide the slipping action described as aforesaid.

The foregoing is a description of a preferred embodiment of the invention which is given here by way of example only. The invention is not to be taken as limited to any of the specific features as described, but comprehends all such variations thereof as come within the scope of the appended claims.

IN THE DRAWINGS

DESCRIPTION OF A SPECIFIC EMBODIMENT

Figure 1:
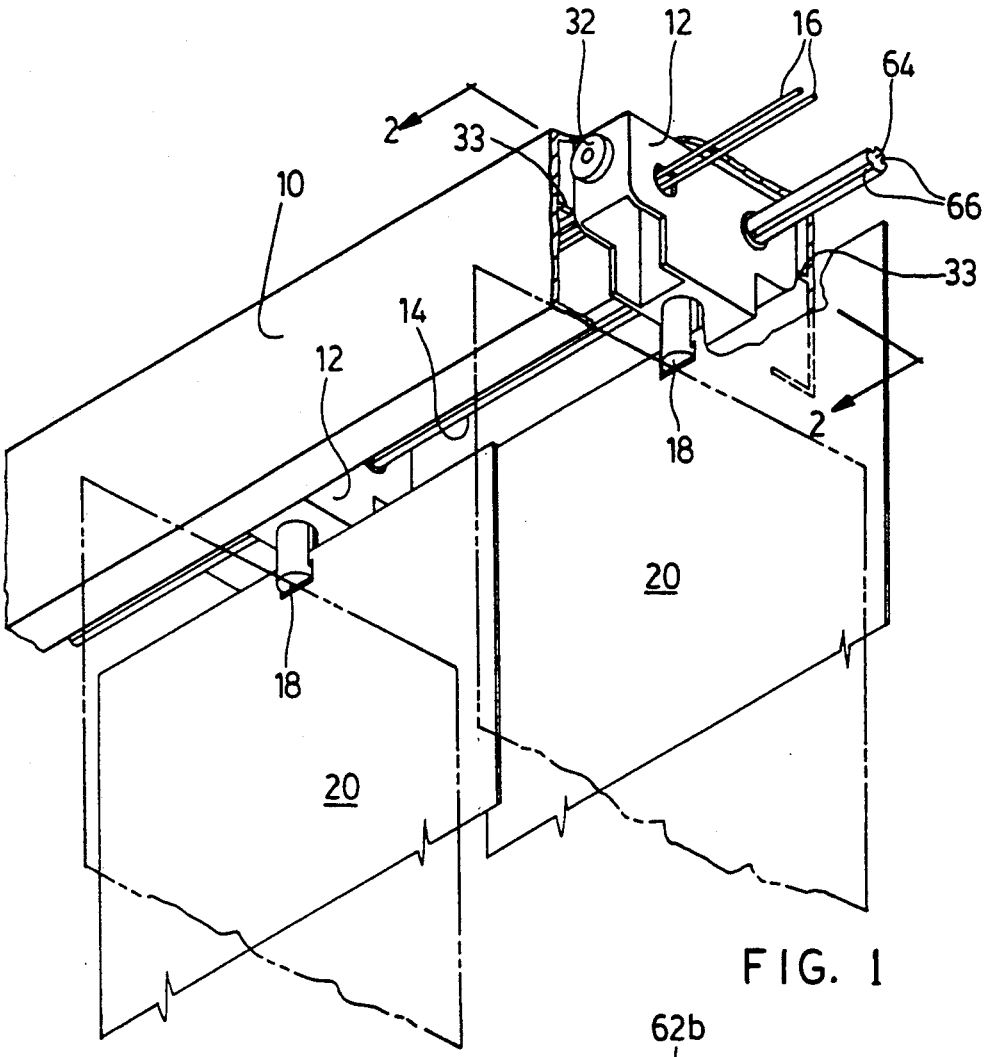
FIG. 1 is a lower front perspective illustration of a typical vertical blind, shown partially cut away.

Turning first to FIG. 1, it will be seen that the invention is here illustrated, for exemplary purposes only, as embodied in a typical vertical blind assembly. Such vertical blind assemblies are well known in the art, and comprise a header rail 10, and a plurality of carriers 12, carriers 12 being slidable along suitable formations (not shown) within the header rail, so that the carriers can be drawn to one end of the header rail, or extended completely across the header rail at spaced intervals. For this purpose the carriers are interconnected by straps or tongues 14 which are usually either flexible or slidable, or both in some cases. Some form of longitudinal movement means, typically such as cords 16—16, run the length of the header rail, and extend around a pulley (not shown) at one end, and are then connected to the lead carrier. In this way, by operation of the pull cord, the carriers can be either drawn to one end of the header rail in a group, or can be drawn the other way and thus extend at spaced intervals completely along the header rail.

In other forms of vertical blinds, the carriers may be moved by means other than a pull cord. In one form of vertical blinds the carriers are in fact driven by a length of helical rod (not shown) of a type well know in the art, extending along the head rail, for driving respective helical nuts (not shown) in respective carriers, so as to cause axial movement of the carriers to and fro along the rail.

The carriers are provided with rotatable slat support shafts 18, and the blind slats 20 are connected to the lower ends of the shafts 18, for example by hooks 22. Hooks 22 are shown merely by way of example. It will of course be appreciated that there are many different designs of carriers and vertical blinds in manufacture, some of which use formations similar to hooks, and others of which use some form of frictional engagement. The details therefore of such means whereby the slats are hung on the shafts may vary from one design to another and is therefore irrelevant for the purposes of the present invention.

Rotation of the shafts 18 will cause the slats 20 to either open or close, and as explained above sliding of the carriers along the header rail will either extend the slats 20 at spaced intervals completely across the area beneath the rail, or alternatively will draw them all to one end of the rail. In some cases, the blind slats may be associated in two groups, and drawn simultaneously to opposite ends.

Figure 2:
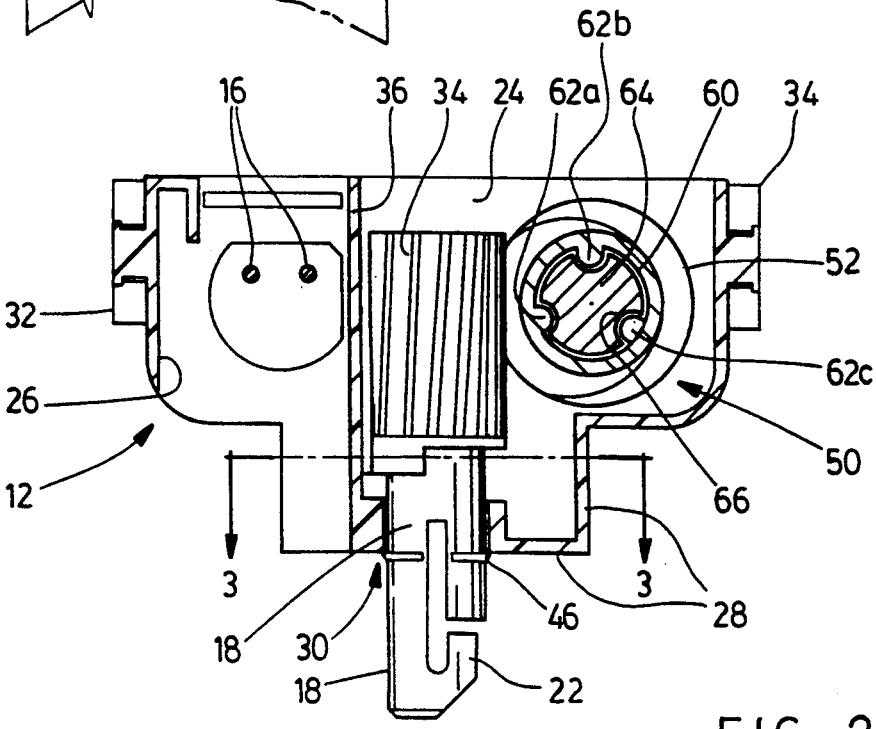
FIG. 2 is a section along the line 2—2 of FIG. 1 through a carrier.
Figure 3:
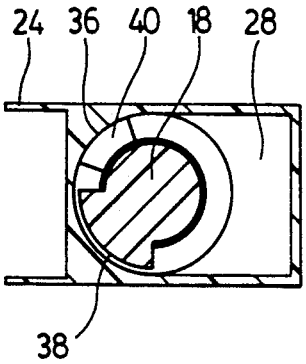
FIG. 3 is a section along the line 3—3 of FIG. 2.

As best shown in FIGS. 2 and 3, each of the carriers in this embodiment comprises housing means, namely side walls 24 and end walls 26, and a recessed bottom wall 28. An opening 30 is formed in the bottom wall 28 to receive the shaft 18.

In order to permit the carriers to move freely along the header rail, bearing wheels 32 are located on each of end walls 26, to ride on suitable rail formations 33 within the header rail.

In order to rotate the shafts 18, each shaft 18 is provided with an integrally formed driven member or gear 34 at its upper end. Gear 34 is oversized with relation to hole 30, and is partially surrounded by a generally semi-cylindrical partition wall 36. A stop member 38 is formed on shaft 18 below gear 34, and a corresponding abutment 40 is formed within the carrier, typically on partition wall 36.

Abutment 40 also engages the underside of the gear 34, and effectively suspends the shaft 18 in the opening 30. The abutment 40 will engage the stop member 38 when it is rotated, by rotation of shaft 18, to one or other of two predetermined rotational positions of shaft 18. The opposite sides of stop member 38 and of abutment 40 thus define the ends of the arc through which the shaft 18 can be rotated.

Partition wall 36 makes a loose tolerance fit around gear 34.

It will also be understood that the gear 34 has a group of teeth 42, integrally moulded therewith extending around an arc of about 180 degrees or slightly less. At each end of the group of teeth 42 there are provided slipping formations **44*a*–44*b*, the precise location of the slipping formations being determined by the ends of the arc through which the shaft 18 is capable of rotating, as defined by the engagement between the stop member 38 and abutment 40**.

Between slipping formations **44*a*–44*b*, there are provided a further set of non-functional gear formations 45**, which might in some circumstances be replaced by a semi-cylindrical surface of the appropriate profile, for reasons to be described below.

A retaining ring 46 is formed on shaft 18, and adapted to make a snap frictional fit through hole 30, so as to retain shaft 18 therein.

In order to rotate gear 34, a drive member or worm drive wheel 50 is provided. Drive wheel 50 comprises a central portion having a drive formation, i.e., a continuous helical series of ridges and grooves 52 and 54.

Figure 4:
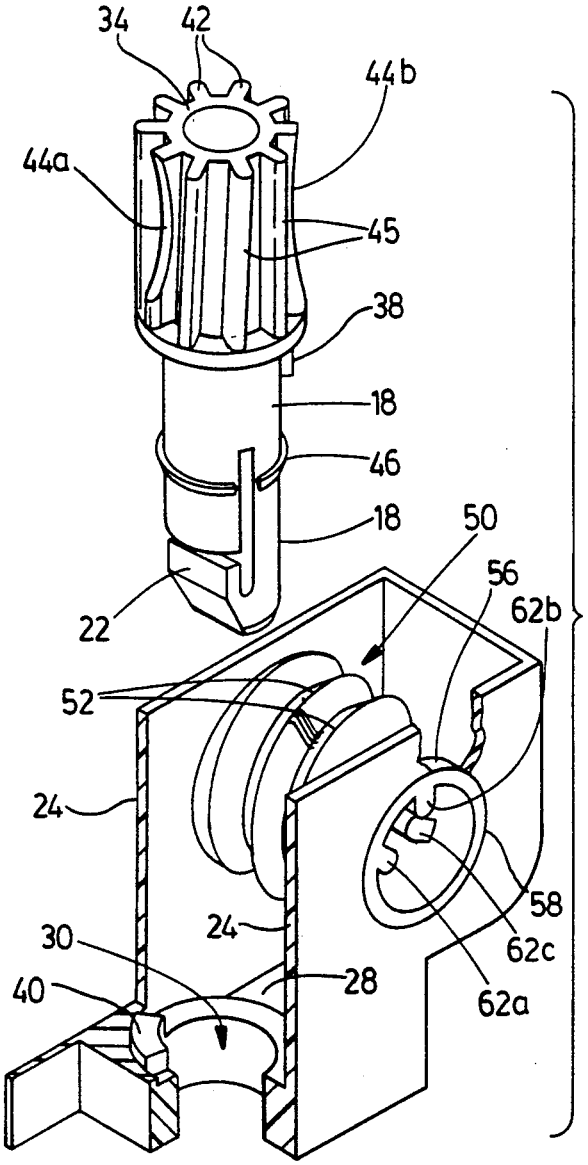
FIG. 4 is an exploded perspective illustration of a portion of the carrier of FIG. 2, partially cut away.
Figure 5:
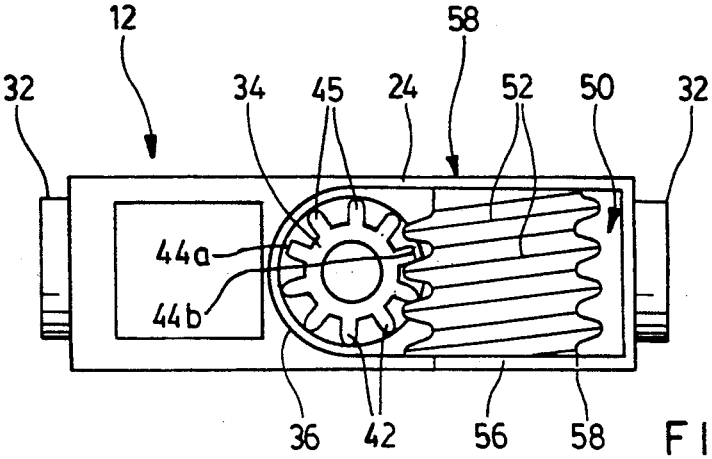
FIG. 5 is a top plan view of the carrier of FIG. 2.

Worm drive wheel 50 further comprises two endwise cylindrical collars 56—56, adapted to fit in bearing openings 58—58 formed in side walls 24—24. A through bore 60 extends completely through worm drive wheel 50, and is formed with drive elements **62*a*, *b* and *c*, there being three such elements in the present case. It will be noted that the drive elements 62*a*, *b* and *c* are not spaced apart by equal arcs, but are in fact located around the interior of bore 60 in an asymmetrical manner, for reasons to be described below. Side walls 24—24 are relatively thin and somewhat flexible, and consequently facilitate the insertion of the worm drive wheel 50 therebetween, being sufficiently flexible to flex apart to permit the collars 56 to be snap-fitted into the holes 58 (FIG. 4**).

It will further be noted (FIG. 4) that whereas two of the drive elements **62*a* and *b* extend completely through the bore 60, the third one of the drive elements indicated as 62*c*** is somewhat shorter, and extends from only one end of the bore partway therethrough, and terminates short of the other end of the bore. The reasons for this will be described as the description proceeds.

In order to rotate the worm drive wheels 50, a control shaft 64 extends along the track 10, passing through the through-bores 60 of the wheels 50. Shaft 64 has grooves 66 formed therein registering with the drive elements 62, whereby rotation of the shaft 64 is transmitted to all of the wheels 50 simultaneously.

As described above in connection with the drive elements 62, the groove 66 will be observed to be arranged in an essentially asymmetrical manner around the shaft 64, so as to correspond to the locations of elements 62, for reasons to be described below.

It will, of course, be appreciated that other forms of drive elements, and grooves, can be formed without departing from the scope of the invention and the number of grooves and ridges and their shape may vary widely. Other forms of drive engaging surfaces could also be employed.

Openings 68—68 are formed in side walls 24—24 for passage of the cords 16—16 therethrough, in this embodiment.

It will be understood that in FIG. 1 the carriers 12 are in their extended position, and the blind slats 20 are shown rotated so as to be fully closed. In this position, which corresponds to the rotational position of the shaft 18 in FIGS. 2 and 3, the stop member 38 is engaging one side of the abutment 40 (FIG. 3). This then effectively ends further rotation of shaft 18 in that direction. This is necessary because as shown in FIG. 1, the blind slats 20—20 overlap one another in the closed position, and if the shafts 18 continue to rotate, the blind slats would then be forced against one another which might cause damage.

If it is desired to open the blind slats, then the control shaft 64 is rotated by any suitable means (not shown) such as a wand or a gear and chain system such as is well known in the art, or in some cases a motor. Rotation of the shaft 64 in the appropriate direction, will procure rotation of all of the worm wheels 50 simultaneously, which will thus rotate all of the gears 34 and their associated shafts 18. This will then cause the blind slats to swing apart from one another as shown in phantom in FIG. 1. Further rotation of the shaft 64 will cause the blind slats 20 to continue to rotate, until they again overlap with one another. In this position, the stop member 38 would again engage the abutment 40, but on the opposite side, as compared with that shown in FIG. 3.

In order to draw the blind slats 20 along the head rail 10, it is usual to open the blind slats 20 by rotating the shaft 64, and then to operate the appropriate one of pull cords 16, (or other traverse control means) so as to move the carriers along the head rail 10.

Reverse movement of the cords 16 (or traverse control means) will cause the carriers to move along the head rail in the reverse direction. For this movement the carriers are enabled to slide along the shaft 64, with the shaft 64 remaining fixed. The worm wheels 50 slide along the shaft 4 to permit this movement.

Once the blind slats are rotated closed, in either direction, then the engagement of the stop members 38 with the abutments 40 will prevent further rotation of the shaft 18.

However, if force continues to be applied to the control shaft 64 attempting to rotate the worm wheels 50 any further, then it is likely that the drive mechanism in at least some of the carriers will become damaged. This is because they are made of relatively thin plastic. For example, some teeth 42 may become stripped on the gear 34 or portions of the ribs 52 of the worm wheels 50 may become broken or, for example, the housing or the stop member 38 or abutment 40 may be damaged.

Once this happens, then the blind is defective and will no longer function in the manner intended, and must be serviced.

In order to overcome this problem, the invention provides for the two slipping formation means, in this case provided by slipping teeth 44*a*–44*b* on gear 34 in each of the carriers. In the present embodiment as shown in FIG. 4, the slipping teeth 44 are formed generally similarly to teeth 42 but with shallow arcuate recesses. The location of slipping teeth 44 must be selected based on the range of arcuate movement of the shaft 18. In other words, once the range of arcuate movement has been limited by engagement of the stop member 38 with the abutment 40 on one end or the other of the extent of arcuate movement, then the slipping formation must register with the rib 52 of the worm wheel 50.

In accordance with the invention, if further torque is then applied to the shaft 64, the tooth 52 will apply a certain degree of rotational force to the slipping formation 44*a* or 44*b* of the gear 34. However, the recesses of formation 44*a* or 44*b* is dimensioned and engineered so as to provide only a minimum of engagement with the ridge 52 of the wheel 50. Due to the somewhat sloppy nature of the tolerances between the gear 34 and the arcuate wall 36, and the thin relatively flexible nature of the plastic forming the walls 24 of the carrier, the gear 34 can then disengage slightly from the wheel 50, allowing the rib 52 to slide past the slipping formation 44. If rotation of the shaft 64 is continued, then this slipping function will continue, harmlessly, without damaging the components.

As explained above, in this embodiment of the invention, there are also a second group of regular gear teeth 45 formed on gear 34, which are in fact never brought into engagement with the drive gear at all. They merely function to engage the partition wall 36, and support the drive gear, somewhat loosely in a more or less vertical position.

Notwithstanding the fact that, at the limits of its rotational arc, the slipping formations provide a slipping function which effectively disengages the drive gear from the driven gear, nonetheless, there is still a certain limited degree of engagement between the rib 52 and the slipping formation 44*a* or *b*, and consequently if rotation of the shaft 64 is reversed, there will be a sufficient degree of engagement to permit it to "catch" the formation 44*a* or *b*, and commence rotation in the reverse direction. Rotation in this direction will, of course, be free and unhindered, and as soon as rotation commences then the wheel 50 will then catch the next tooth 42 on the gear 34 and so on.

The same slipping function will occur once the rotation has been completed, at the other end of the arcuate extent of the rotation of the shaft 18.

It will be thus seen by the present invention, there is provided a torque limiting effect, between the worm wheel 50 and the drive gear 34, without the necessity of manufacturing, and assembling, several different small plastic components in each of the carriers.

Reverting back once again to the description of the through bore 60 drive formations 62 and shaft 64, it will be recalled that the location of the drive formations, and the grooves, around their respective bores and shafts is asymmetrical. This is so as to provide that the shafts, and bores, can be associated together only when they are in a predetermined rotational position. This rotational position corresponds to the same rotational position for each of the gear shafts of each of the carriers. Thus the drive shafts, during the assembly of such drive shafts through the carriers, can only be inserted, when the gear shafts of each of the slats is in the correct rotational position.

It will also be recalled that whereas two of the drive formations 62 of the bore 60 were extending the full length of the bore the third one of the drive formations 62 was only of partial length.

This is to ensure that personnel assembling the carrier assemble the worm drive members in the correct orientation, i.e., that they are not inadvertently reversed or put in backwards from one carrier as compared to the next.

Figure 8:
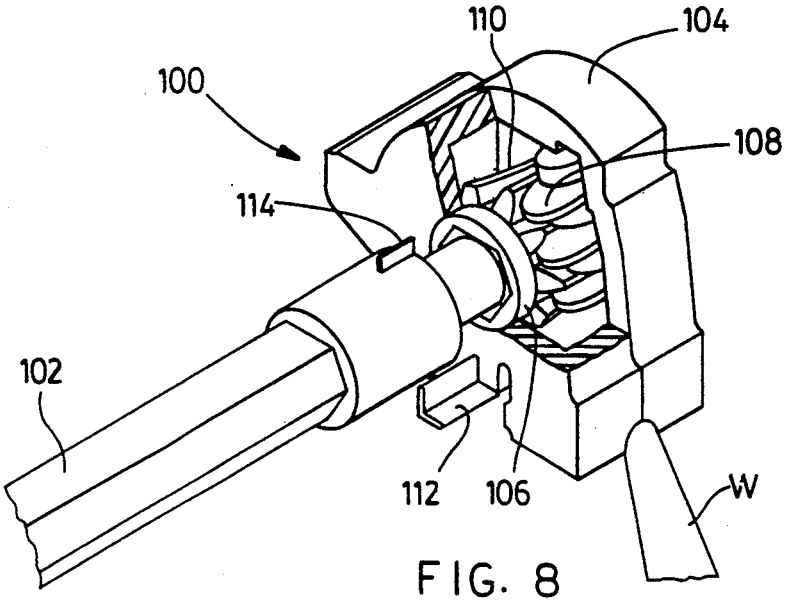
FIG. 8 is a perspective of an alternate embodiment for a venetian blind.

Furthermore, as already explained herein, the invention is also applicable with minor modifications to the worm and gear drive mechanism of a horizontal venetian type blind mechanism 100, such as is shown in general in FIG. 8. In this type of blind, as is well known, a head rail (not shown) carries a rotatable tilt shaft 102. The tilt shaft 102 carries two or more pairs of suspension cords 104 on which blind slats (not shown) are supported. Various different makes of such blinds are well known and available, and the details are omitted for the sake of clarity.

Rotation of the tilt rod, will cause the blind slats to tilt simultaneously one way or the other to open or close the blind.

A separate set of pull cords, forming no part of the present invention permits all of the blind slats to be raised or lowered to open or close the window, in a manner well known in the art and requiring no description.

In order to rotate the tilt shaft 102, a gear drive housing 104 is provided at one end of the head rail. The housing 104 carries a driven gear wheel 106, adapted to the interconnected with the tilt shaft 102 A worm drive wheel 108 is rotatably mounted in the housing and it engages the gear drive. Rotation of the worm drive is usually achieved by means of a control wand W, or other means well known in the art.

In accordance with the present invention, slipping formations 110 may be formed on the gear 106, at the limits of its travel. Usually, the limits of the travel, in a venetian blind assembly, are defined by means such as abutments 112 formed on the exterior of the housing 104, and engaging a stop member 114, connected in some suitable manner to the tilt shaft.

Figure 6:
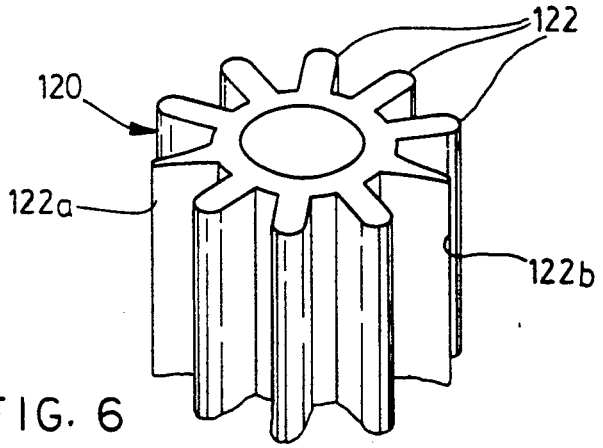
FIG. 6 is a perspective of a further alternate embodiment of slipping formations.

Other forms of slipping means could be provided for both vertical slat blinds and horizontal slat venetian blinds as shown in FIG. 6. For example, a gear 120 could be made having two slipping teeth formations 122*a* and 122*g* which are relatively thin and flexible teeth compared with the remainder of the gear teeth 122, so that they could simply be deflected sideways by excessive torque (see FIG. 6).

Figure 7:
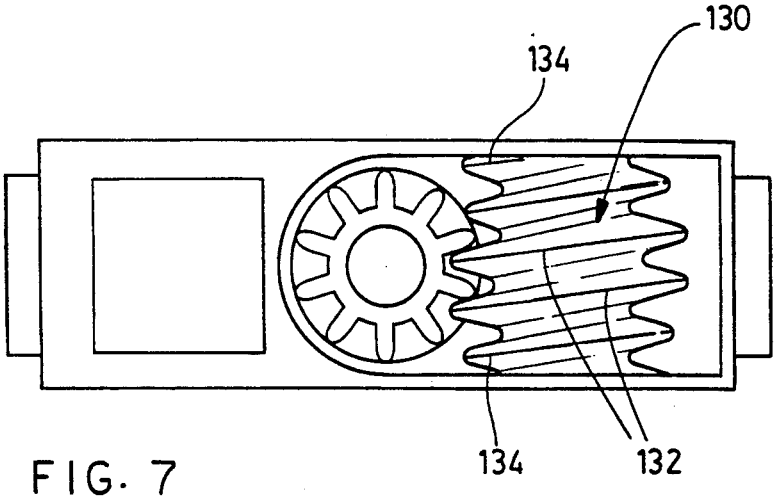
FIG. 7 is a perspective illustration showing an alternate form of torque-limiting device for use in both vertical and venetian blinds.

In another embodiment (FIG. 7) a worm drive 130 could be provided with a ridge 132 having slipping formations 134 at each end, of reduced height as compared with ridge 132, which would function to provide a slipping action at each end of ridge 132. This could be adapted with minor modifications to venetian blinds in the same way.

In accordance with the still further embodiment of the invention, slipping formation means can also be provided in yet another way.

Figure 9:
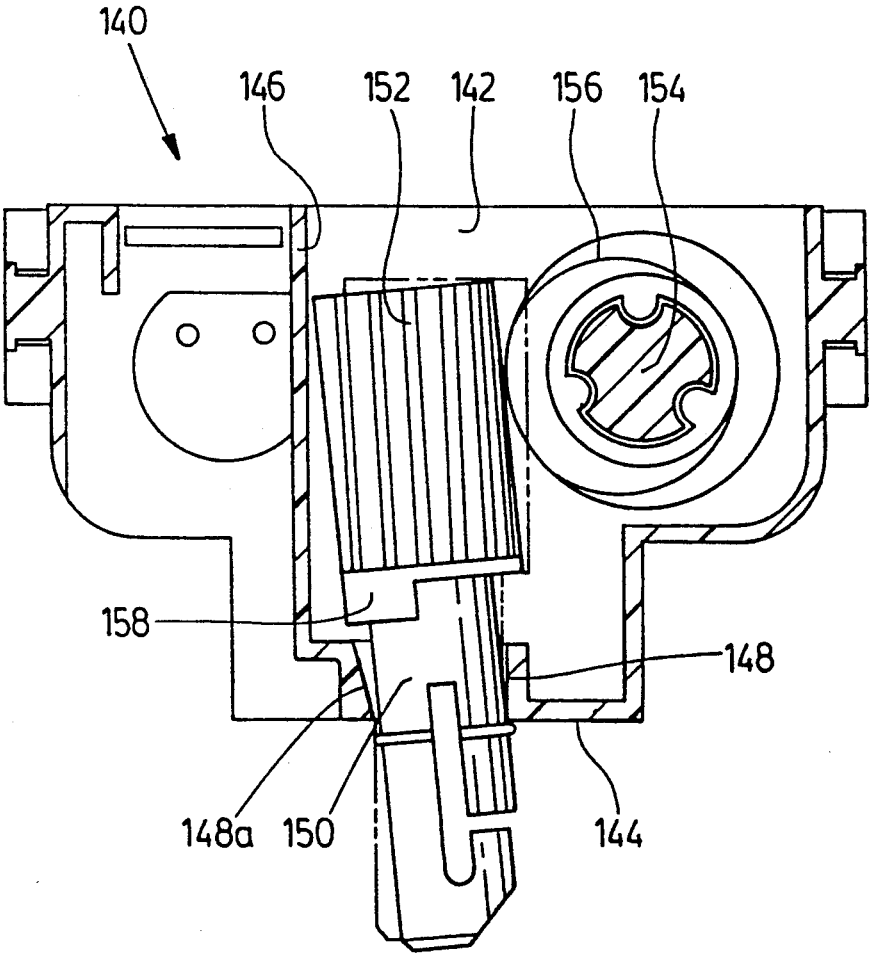
FIG. 9 is a section corresponding to FIG. 2, of a further alternate embodiment of the invention, and showing two positions thereof, one of them in phantom.

In the embodiment of FIG. 9, a carrier indicated generally as 140 has side walls 142—142, a bottom wall 144, and a partition wall 146. A hole 148 is formed through partition wall 146, and a shaft 150 passes through hole 148. A drive gear 152 is formed on shaft 150. A control shaft 154 passes through a helical worm drive gear 156, which engages driven gear 152.

It will be noted in this embodiment that hole 148 is formed with a generally flared or semi-conical wall portion 148*a* on one side opposite to drive gear 156. It will also be noted that wall 146 is spaced from gear 152 a somewhat greater distance than in the embodiment of FIG. 2.

A stop member 158 formed on shaft 150 engages the usual abutment (not shown) formed on the carrier 140 similar to that described in connection with FIG. 2.

In normal operation, the shaft 150 hangs more or less vertically under the weight of its associated blind slat (not shown) in the same way as is shown in FIG. 1.

Rotation of shaft 154 and worm wheel 156 will thus cause rotation of driven gear 152 causing the slats to rotate one way or the other.

However, when the shaft 150 is rotated so that its stop member 158 engages the abutment (not shown) at one or other end of its rotational travel, then it can rotate no further. In this position, if the shaft 154 and wheel 156 are then rotated further, it will simply have the effect of tilting or tipping the shaft 150 as shown in solid lines in FIG. 9 away from the wheel 156, and thus will provide a slipping action.

The same slipping action will be achieved at the other end of the limit of the rotational arc of shaft 150.

The foregoing is a description of a preferred embodiment of the invention which is given here by way of example only. The invention is not to be taken as limited to any of the specific features as described, but comprehends all such variations as come within the scope of the appended claims.

What is claimed is:

1. A torque-limiting angle drive for blinds and comprising:

drive housing means adapted to be incorporated in a blind;

a drive gear member rotatably supported on said housing means in first bearing means for rotation about its respective axis, and defining worm drive formation means;

a driven gear member rotatably supported on said housing means in second bearing means for rotation about its respective axis;

stop means adapted to define ends of a predetermined arc of rotation less than 360 degrees for said driven member;

a plurality of driven gear tooth formations on said driven member at spaced intervals therearound arranged in a group extending substantially around said predetermined arc of rotation, and adapted to be driven by said worm drive formations and, a plurality of slipping teeth arranged on said driven member and located whereby when said driven member reaches one or other end of its predetermined arc of rotation, said slipping teeth are disengaged whereby to provide a slipping action when said drive member is over-rotated and wherein said slipping teeth define a profile having a generally arcuate concave shape, whereby to permit said worm drive formations to slip thereon.

2. A torque-limiting angle drive as claimed in claim 1, wherein said gear teeth comprise a first group of gear teeth, defining a predetermined arcuate extent of rotation of said drive means, and second group of said gear teeth extending between said slipping formations, said second group of gear teeth being out of engagement with said driven member.

3. A torque drive assembly as claimed in claim 1 wherein said blind slats are adapted to be suspended in vertical side by side orientation from said headrail means.

4. A torque drive assembly as claimed in claim 1 wherein said blind slats are adapted to be suspended in horizontal side by side parallel relation one above the other from said headrail means.

5. A torque drive assembly as claimed in claim 1 wherein there are a plurality of said drive housing means, each of said drive housing means including carrier means for a said blind slat.

6. A torque drive assembly as claimed in claim 1 wherein said drive housing means is located at one end of said headrail, and wherein said headrail incorporates tilt shaft means extending therealong, connected to said drive housing means, for operation thereof.

7. A torque-limiting angle drive for blinds and comprising:

drive housing means adapted to be incorporated in a blind;

a drive gear member rotatably supported on said housing means in first bearing means for rotation about its respective axis, and defining drive formation means;

a driven gear member rotatably supported on said housing means in second bearing means for rotation about its respective axis;

stop means adapted to define ends of a predetermined arc of less than 360 degrees for rotation said driven member;

a plurality of driven gear tooth formations on said driven member at spaced intervals therearound arranged in a group extending substantially around said predetermined arc of rotation, and, a plurality of slipping teeth arranged on said driven member and located whereby when said driven member reaches one or other end of its predetermined arc of rotation, said slipping teeth are disengaged whereby to provide a slipping action when said drive member is over-rotated wherein said driven gear teeth have a predetermined thickness, and a predetermined rigidity, and wherein said slipping teeth comprise a predetermined thickness less than said thickness of said driven gear teeth, and having a predetermined degree of flexibility, whereby they can flex to allow said drive formation means to slip thereon.

8. A torque drive assembly as claimed in claim 7 wherein said blind slats are adapted to be suspended in vertical side by side orientation from said headrail means.

9. A torque drive assembly as claimed in claim 7 wherein said blind slats are adapted to be suspended in horizontal side by side parallel relation one above the other from said headrail means.

10. A torque drive assembly as claimed in claim 7 wherein there are a plurality of said drive housing means, each of said drive housing means including carrier means for a said blind slat.

11. A torque drive assembly as claimed in claim 7 wherein said drive housing means is located at one end of said headrail, and wherein said headrail incorporates tilt shaft means extending therealong, connected to said drive housing means, for operation thereof.

12. A torque-limiting angle drive for blinds and comprising;

drive housing means adapted to be incorporated in a blind;

a drive gear member rotatably supported on said housing means in first bearing means for rotation about its respective axis, and defining a worm gear;

a driven gear member rotatably supported on said housing means in second bearing means for rotation about its respective axis and connectable to said tilt rod for rotation thereof;

stop means adapted to define ends of a predetermined arc of less than 360 degrees for rotation said driven member;

a plurality of driven gear tooth formations on said driven member at spaced intervals therearound arranged in a group extending substantially around said predetermined arc of rotation;

said worm gear having a continuous drive ridge formation thereon, said drive ridge formation having a predetermined profile, and defining two ends, each of said ends defining a predetermined reduced profile, whereby to provide slipping formation means, thereon allowing same to slip in relation to said driven gear at each end of said predetermined profile.

13. A torque-limiting angle drive as claimed in claim 12, wherein said angle drive forms a component of a horizontal venetian blind assembly.

14. A torque drive assembly as claimed in claim 12 wherein said blind slats are adapted to be suspended in vertical side by side orientation from said headrail means.

15. A torque drive assembly as claimed in claim 12 wherein said blind slats are adapted to be suspended in horizontal side by side parallel relation one above the other from said headrail means.

16. A torque drive assembly as claimed in claim 12 wherein there are a plurality of said drive housing means, each of said drive housing means including carrier means for a said blind slat.

17. A torque drive assembly as claimed in claim 12 wherein said drive housing means is located at one end of said headrail, and wherein said headrail incorporates tilt shaft means extending therealong, connected to said drive housing means, for operation thereof.

18. A torque-limiting angle drive for vertical slat blinds of the type having slat carriers movable in a track and comprising:

drive housing means adapted to be incorporated in a carrier;

a drive gear member rotatably supported on said housing means in first bearing means for rotation about its respective axis, and defining worm drive formation means;

a driven gear member rotatably supported on said housing means in second bearing means for rotation about its respective axis;

stop means adapted to define ends of a predetermined are of rotation less than 360 degrees for said driven member;

a plurality of driven gear tooth formations on said driven member at spaced intervals therearound arranged in a group extending substantially around said predetermined arc of rotation, and adapted to be driven by said worm drive formations and, wherein said second bearing means receiving said driven member, is formed with a flared semi-conical wall portion, permitting said driven member to tilt out of its normal axis, whereby to provide a slipping action between said drive member and said driven member said ends of said predetermined arc of rotation of said member.

19. A blind assembly of the type having a plurality of blind slats which are rotatable between open and closed positions, by rotation of said blind slats, said blind slats being controllable by control shaft means, said blind assembly comprising:

headrail means;

suspension means for suspending blind slats from said headrail means, and blind slats adapted to be suspended therefrom;

drive means in said headrail, said drive means further comprising;

drive housing means located in said headrail;

a drive gear member rotatably supported on said housing means in first bearing means for rotation about its respective axis, and defining worm drive formation means;

a driven gear member rotatably supported on said housing means in second bearing means for rotation about its respective axis;

stop means adapted to define ends of a predetermined arc of rotation of said driven gear member;

a plurality of teeth on said driven gear member at spaced intervals therearound arranged in a group extending substantially around said predetermined arc of rotation, and, slipping teeth on said driven member and located whereby when said driven member reaches one or other end of its arc of rotation, said slipping teeth are disengaged whereby to provide a slipping action when said drive member is over-rotated wherein said slipping teeth define a profile having a generally arcuate concave shape, whereby to permit said worm drive formations to slip thereon.

20. A blind assembly as claimed in claim 19 wherein said blind slats are adapted to be suspended in vertical side by side orientation from said headrail means.

21. A blind assembly as claimed in claim 19 wherein said blind slats are adapted to be suspended in horizontal side by side parallel relation one above the other from said headrail means.

22. A blind assembly as claimed in claim 21 wherein said drive housing means is located at one end of said headrail, and wherein said headrail incorporates tilt shaft means extending therealong, connected to said drive housing, for operation thereof.

23. A blind assembly as claimed in claim 19 wherein there are a plurality of said drive housing means, each of said drive housing means including carrier means for a said blind slat.

24. A blind assembly as claimed in claim 19 wherein said blind slats are adapted to be suspended in vertical side by side orientation from said headrail means.

25. A blind assembly as claimed in claim 19 wherein said blind slats are adapted to be suspended in horizontal parallel relation one above the other from said headrail means.

26. A blind assembly as claimed in claim 19 wherein there are a plurality of said drive housing means, each of said drive housing means including carrier means for a said blind slat.

27. A blind assembly as claimed in claim 19 wherein said drive housing means is located at one end of said headrail, and wherein said headrail incorporates tilt shaft means extending therealong, connected to said drive housing means, for operation thereof.

28. A vertical blind assembly of the type having blind carriers slidable along a blind track each carrying a vertical blind slat, each of said carriers incorporating a drive assembly and comprising;

a drive member rotatably supported in said carrier and having drive formations;

a driven member rotatably supported in said carrier and means for suspending a said blind slat therefrom and having driven formations;

slipping formation means on one of said drive member and said driven member, operable to slip if said drive member is rotated beyond a predetermined point;

an opening through said drive member;

a drive shaft adapted to be slidingly received in said opening;

a plurality of spaced apart rib members on one of said drive member and said drive shaft, and, a plurality of spaced apart grooves in the other of said drive member and said drive shaft adapted to receive respective said rib members on the other of said drive member and said drive shaft and wherein said rib members and said groove members are located asymmetrically around a central axis of said drive shaft and said drive member, whereby said drive shaft and said drive member can be assembled only in one predetermined relationship.

29. A vertical blind assembly as claimed in claim 28, and wherein said rib members are formed on said driven member and wherein said grooves are formed in said drive shaft, and wherein said rib members incorporate at least one said rib member of a first length and at least one other said rib member of a second length less than said first length.

30. A blind assembly of the type having a plurality of blind slats which are rotatable between open and closed positions, by rotation of said blind slats, said blind slats being controllable by control shaft means, said blind assembly comprising;

headrail means;

suspension means for suspending blind slats from said headrail means, and blind slats adapted to be suspended therefrom;

drive means in said headrail, said drive means further comprising;

drive housing means incorporated in said headrail;

a drive gear member rotatably supported on said housing means in first bearing means for rotation about its respective axis, and defining drive formation means;

a driven gear member rotatably supported on said housing means in second bearing means for rotation about its respective axis;

stop means adapted to define ends of a predetermined arc of less than 360 degrees of rotation said driven member;

a plurality of driven gear tooth formations on said driven member at spaced intervals therearound arranged in a group extending substantially around said predetermined arc of rotation, and, a plurality of slipping teeth arranged on said driven member and located whereby when said driven member reaches one or other end of its predetermined arc of rotation, said slipping teeth provide a slipping action when said drive member is overrotated and wherein said driven gear teeth have a predetermined thickness, and a predetermined rigidity, and wherein said slipping teeth comprise a predetermined thickness less than said thickness of said driven gear teeth means, and having a predetermined degree of flexibility, whereby they can flex to allow said drive formation means to slip.

31. A blind assembly as claimed in claim 30 wherein said blind slats are adapted to be suspended in vertical side by side orientation from said headrail means.

32. A blind assembly as claimed in claim 30 wherein said blind slats are adapted to be suspended in horizontal parallel relation one above the other from said headrail means.

33. A blind assembly as claimed in claim 30 wherein there are a plurality of said drive housing means, each of said drive housing means including carrier means for a said blind slat.

34. A blind assembly as claimed in claim 30 wherein said driving housing means is located at one end of said headrail, and wherein said headrail incorporates tilt shaft means extending therealong, connected to said drive housing means, for operation thereof.

35. A blind assembly having a headrail and blind slats suspended from said headrail, and a torque limiting drive for controlling said slats, and comprising;

housing means adapted to be incorporated in a said headrail;

a drive gear member rotatably supported on said housing means in first bearing means for rotation about its respective axis, and defining worm drive formation means;

a driven gear member rotatably supported on said housing means in second bearing means for rotation about its respective axis;

stop means adapted to define ends of a predetermined arc of less than 360 degrees for rotation said driven member;

a plurality of driven gear tooth formations on said driven member at spaced intervals therearound arranged in a group extending substantially around said predetermined arc of rotation, and wherein:

said worm drive formation means define a continuous drive ridge formation thereon, said drive ridge formation having a predetermined profile, and defining two ends, each of said ends defining a predetermined reduced profile, whereby to provide slipping formation means, thereon allowing same to slip in relation to said driven gear tooth formations.

36. A blind assembly as claimed in claim 35 wherein said blind slats are adapted to be suspended in vertical side by side orientation from said headrail means.

37. A blind assembly as claimed in claim 35 wherein said blind slats are adapted to be suspended in horizontal parallel relation one above the other from said headrail means.

38. A blind assembly as claimed in claim 35 wherein there are a plurality of said drive housing means, each of said drive housing means including carrier means for a said blind slat.

39. A blind assembly as claimed in claim 35 wherein said drive housing means is located at one end of said headrail, and wherein said headrail incorporates tilt shaft means extending therealong, connected to said drive housing means, for operation thereof.

40. A vertical slat blind assembly of the type having slat carriers movable in a track and vertical slats suspended therefrom and comprising:

drive housing means adapted to be incorporated in a carrier;

a drive gear member rotatably supported on said housing means in first bearing means for rotation about its respective axis, and defining worm drive formation means;

a driven gear member rotatably supported on said housing means in second bearing means for rotation about its respective axis;

stop means adapted to define ends of a predetermined arc of rotation less than 360 degrees for said driven member;

a plurality of driven gear tooth formations on said driven member at spaced intervals therearound arranged in a group extending substantially around said predetermined arc of rotation, and adapted to be driven by said worm drive formations and, wherein said second bearing means receiving said driven member, is formed with a flared semi-conical wall portion, permitting said driven member to tilt out of its normal axis, whereby to provide a slipping action between said drive member and said driven member at said ends of said predetermined arc of rotation of said driven member.

* * * * *